US007429224B2

(12) United States Patent
Publicover

(10) Patent No.: US 7,429,224 B2
(45) Date of Patent: Sep. 30, 2008

(54) BASKETBALL HOOP AND BACKBOARD FOR A TRAMPOLINE

(76) Inventor: Mark W. Publicover, 18505 Marshall La., Saratoga, CA (US) 95070

( * ) Notice: Subject to any disclaimer, the term of this patent is extended or adjusted under 35 U.S.C. 154(b) by 144 days.

(21) Appl. No.: 11/226,070

(22) Filed: Sep. 13, 2005

(65) Prior Publication Data

US 2006/0058123 A1 Mar. 16, 2006

Related U.S. Application Data

(60) Provisional application No. 60/609,882, filed on Sep. 13, 2004.

(51) Int. Cl.
*A63B 63/08* (2006.01)

(52) U.S. Cl. ..... 473/479; D21/702

(58) Field of Classification Search ..... 473/481, 473/447, 448, 422, 479; D21/781, 707
See application file for complete search history.

(56) References Cited

U.S. PATENT DOCUMENTS 4,799,679 A * 1/1989 Obram ..... 473/486
4,846,469 A * 7/1989 Nye ..... 473/486
5,348,289 A * 9/1994 Vaught ..... 473/486
5,456,459 A * 10/1995 Gorman ..... 473/486
5,586,759 A * 12/1996 Fitzsimmons et al. ..... 473/486
5,607,149 A * 3/1997 van Nimwegen et al. .... 473/479
5,816,955 A * 10/1998 Nordgran et al. ..... 473/486
6,935,966 B2 * 8/2005 Kershaw ..... 473/248

* cited by examiner

*Primary Examiner*—Gene Kim
*Assistant Examiner*—M Chambers
(74) *Attorney, Agent, or Firm*—Edward S. Sherman, Esq.

(57) ABSTRACT

A padded basketball hoop is flexibly mounted to a backboard or other rigid vertical surface via an energy or shock absorbing connection device disposed between the backboard and the vertical surface supporting the hoop. The hoop responds to upward and downward vertical displacement by transferring energy to the shock absorbing connector, wherein the absorbing connector then urges said hoop to a substantially horizontal orientation. The hoop is particularly useful connection with play on a trampoline or other instances where players are likely to connect the rim during upward.

10 Claims, 6 Drawing Sheets

BASKETBALL HOOP AND BACKBOARD FOR A TRAMPOLINE

CROSS REFERENCE TO RELATED APPLICATIONS

The present application claims priority to the provisional application having Ser. No. 60/609,882 titled "Basketball Hoop and Backboard for a Trampoline", filed on Sep. 13, 2004, which is incorporated herein by reference.

BACKGROUND OF THE INVENTION

Prior methods of mounting backboard assemblies allow vibration and flexure of the rim to a minimal extent. Thus, if such a rim is used on a trampoline or other rebounding surface, inattentive players can be injured by making contact with such a rim during the upward bounce, or engaging in extremely rough play, which is not advised.

Indeed there is a general need for basketball hoop assemblies that absorb energy to avoid injury to players, yet that are sufficiently rigid not to interfere with the interplay between a ball hitting or curling downward on the edge of the rim that players have come to expect from traditional substantially rigid basketball rims.

It is therefore a first object of the present invention to provide a backboard and rim assembly that mounts on a trampoline.

It is another object to provide for safer player contact with the rim during upward movement.

It is yet another object of the invention to provide an energy-absorbing rim that does not adversely influence the play or interaction of the basketball with the hoop portion thereof in a significant manner.

SUMMARY OF INVENTION

In the present invention, the first object is achieved by padding the rim with a surrounding elastic member.

A second aspect of the invention is characterized in that two pairs of springs are deployed such that rim assembly can flex in the vertical direction absorbing energy, but is readily restored to the substantially horizontal orientation when the deflecting load is released.

The above and other objects, effects, features, and advantages of the present invention will become more apparent from the following description of the embodiments thereof taken in conjunction with the accompanying drawings.

BRIEF DESCRIPTION OF DRAWINGS

FIG. 5 B is a cross-sectional elevation of the basketball backboard and rim assembly taken orthogonal to the backboard surface and bisecting the connecting bolts.

DETAILED DESCRIPTION

Figure 1:
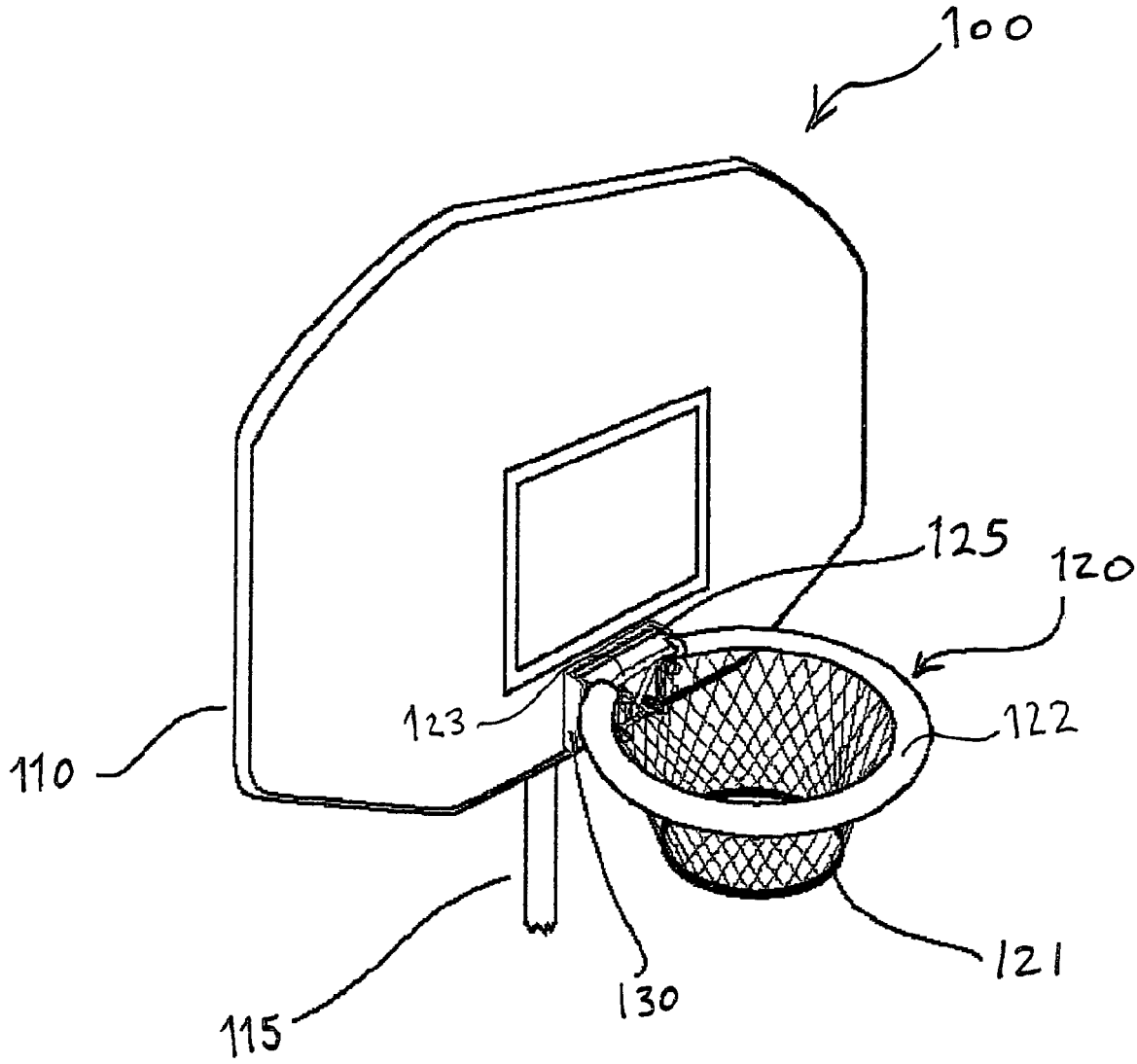
FIG. 1 is a perspective illustration from above and to the side of the basketball backboard and rim assembly showing the front thereof.

Referring to FIGS. 1 through 6 wherein like reference numerals refer to like components in the various views, there is illustrated herein a new and improved Basketball Backboard for a Trampoline, generally denominated 100 herein.

Figure 4:
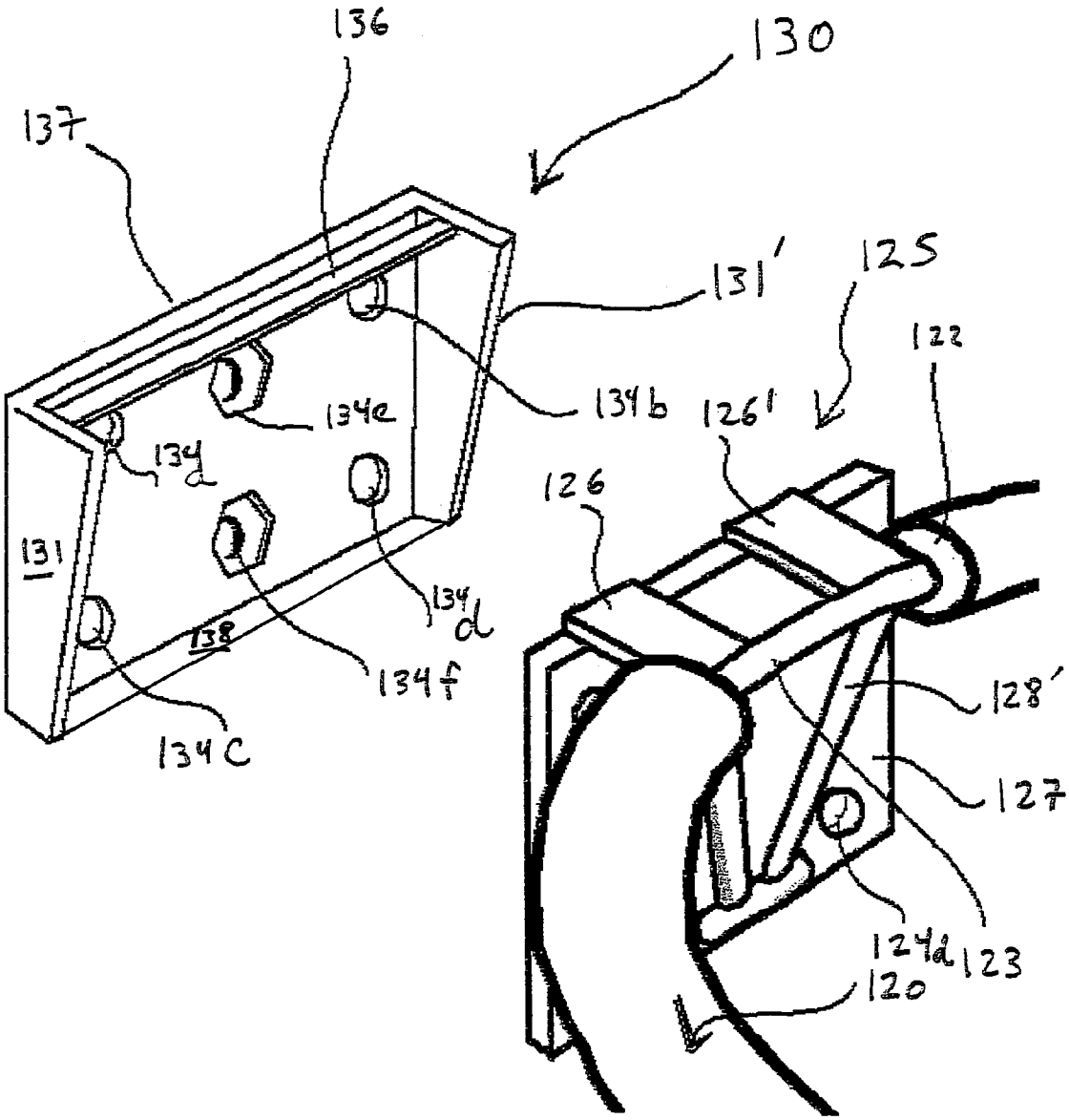
FIG. 4 is an exploded perspective view showing the mounting of the rim and support structure to a front plate for attachment to the front of the backboard substantially corresponding with the exploded view in FIG. 3.

In another embodiment of the invention, best appreciated by reference to FIGS. 1 and 4, the rim 123 is padded by a layer of an elastic material 122. Such elastic material can readily be formed from a foam or elastic tube by first proving a length substantially corresponding to the circumference of the rim. The tube is then longitudinally split from the side to the center of the tube. On one side of the slit mating components of a hook and loop type faster (commonly known by the trademark "VELCRO"), is bonded with the opposite mating member attached to the other side of the slit. After the elastic material or padding and a connected net are mounted on the rim (by inserting the rim through the slit and conforming the linear tube to the circular form the rim) the opposing hook and loop faster stitched into opposing sides of the slit tube are connected.

In accordance with the present invention, rim assembly 120 is mounted to the backboard 110 on the upper end of pole 115 so that the backboard may be disposed within or at the edge of a trampoline (not shown), in which pole 115 would correspond with a safety enclosure-supporting pole of the trampoline. Conventional style net 121 is downwardly suspended from rim 120 being connected to a foam or other elastic energy absorbing member 122 that covers and surrounds rim 123.

In one aspect of the invention, the hoop portion or rim 123 of the basketball rim assembly 120 responds to upward and downward vertical displacement by transferring energy to the shock absorbing connector generally denominated 125 to the L-shaped plate 125 which attaches the rim 120 to the backboard 110. L-shaped plate 125 is shown in significant detail in subsequent Figures, and forms an absorbing connector assembly with other components such that the hoop or rim 120 is returned to substantially horizontal orientation after such impact . The inventive hoop is particularly useful in connection with play on a trampoline or other instances where players are likely to contact the rim during upward movement, especially under conditions when the energy exceeds the capacity of elastic member 122.

It should be understood that the rim 123 may be directly mounted on any alternative substantial rigid vertical surface as an alternative to backboard 110 and supporting pole 115.

Figure 2:
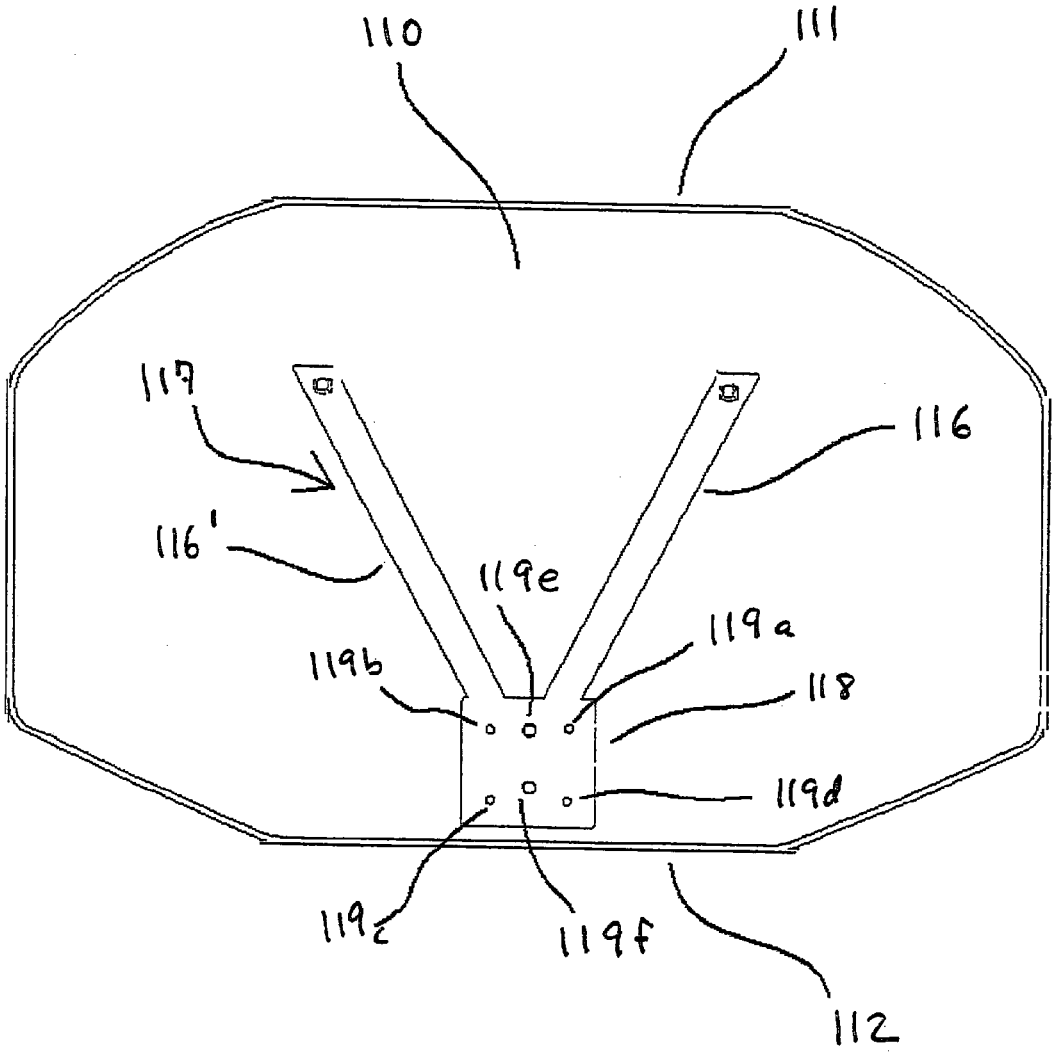
FIG. 2 is a rear elevation of the backboard and brace.

In a preferred embodiment, shown in rear elevation in FIG. 2, a Y-shaped brace 116 is attached to the rear side of backboard 110. A square shaped plate 118 at the bottom of Y-shape brace 116 is disposed just above the bottom edge 112, with edge 111 denoting the top of the backboard 110. The square shaped plate portion 118 has four through holes 119*a, b, c* and *d* arrayed to form the corners of a square centered within plate 118, the holes extending through the backboard 110. Square shaped plate 118 has two additional through holes 119*e* that also pass through the backboard 110. As will be further described with respect to FIGS. 4, 5 and 6, holes 119*e* and *f* are for mounting receiving plate 130 to the front side of backboard 110. Receiving plate 130 includes sidewalls 131 and 131' as well at least a partial upper wall at bar 136 that is connected to the top of sides 131 and 131'. A lower edge 138 extends from side 131 to 131', having an inner edge in connect with the lower surface of square vertical face 137.

Figures 5A, 5B:
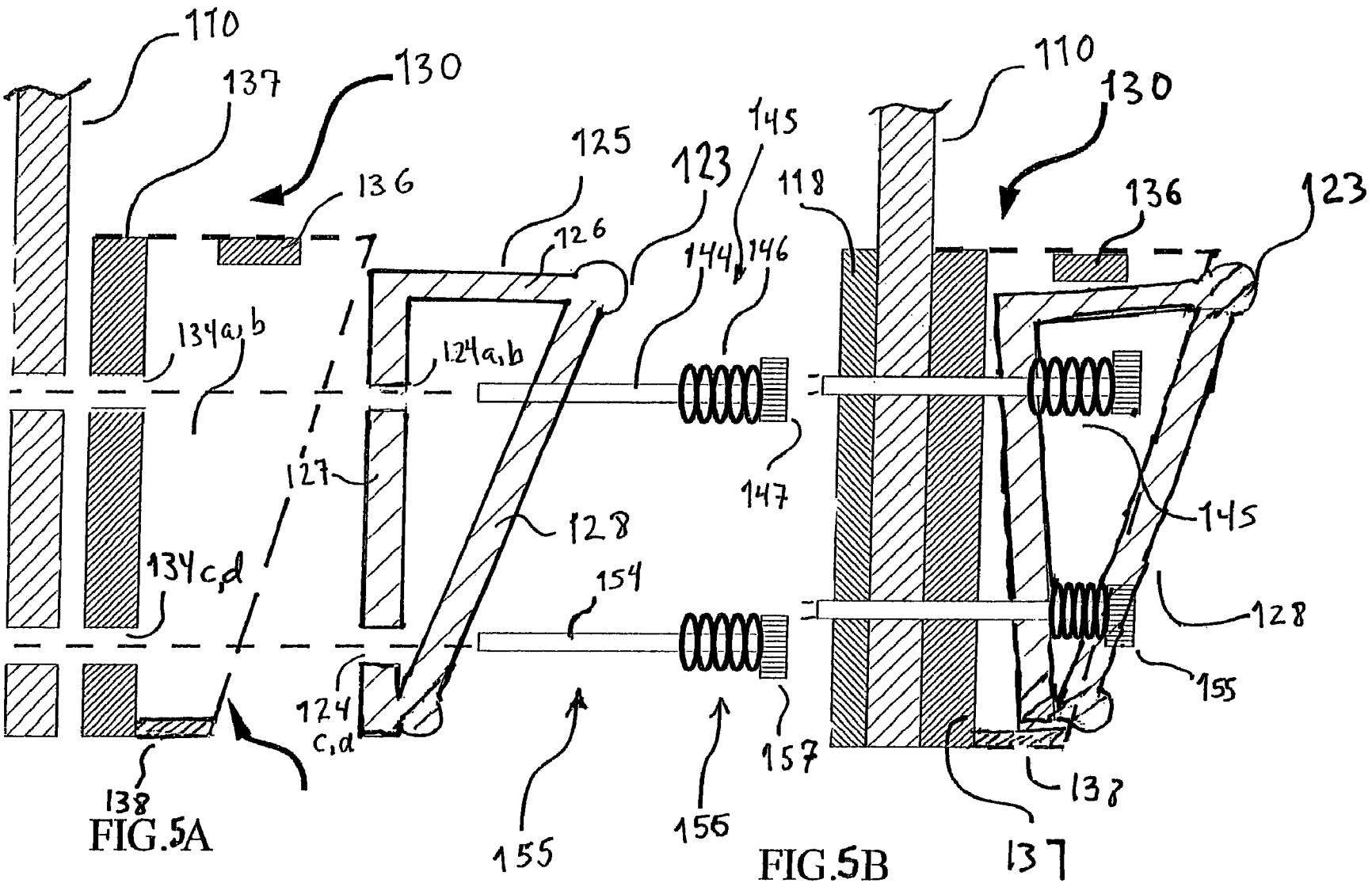
FIG. 5 A is a cross-sectional elevation of the exploded views of FIGS. 3 and 4 taken orthogonal to the backboard surface and bisecting the connecting bolts.

Thus, referring to FIG. 5A, which is an elevation at the vertical section that bisects bolts 145 and 155, these bolt in the final assembly 100 pass through the quartet of holes arranged in a square pattern in each of square shaped plate 118, receiving plate vertical face 137 and the square vertical face 137 of L-shaped receiving plate 130. Preferably, threads are provided on the inner surfaces of holes 134*a, b, c* and *d* to mate with and secure bolt pair 145 and 155 thereto. Thus, backboard 110 is effectively bonded between the square shaped plate 118 and the receiving plate 130.

Figure 3:
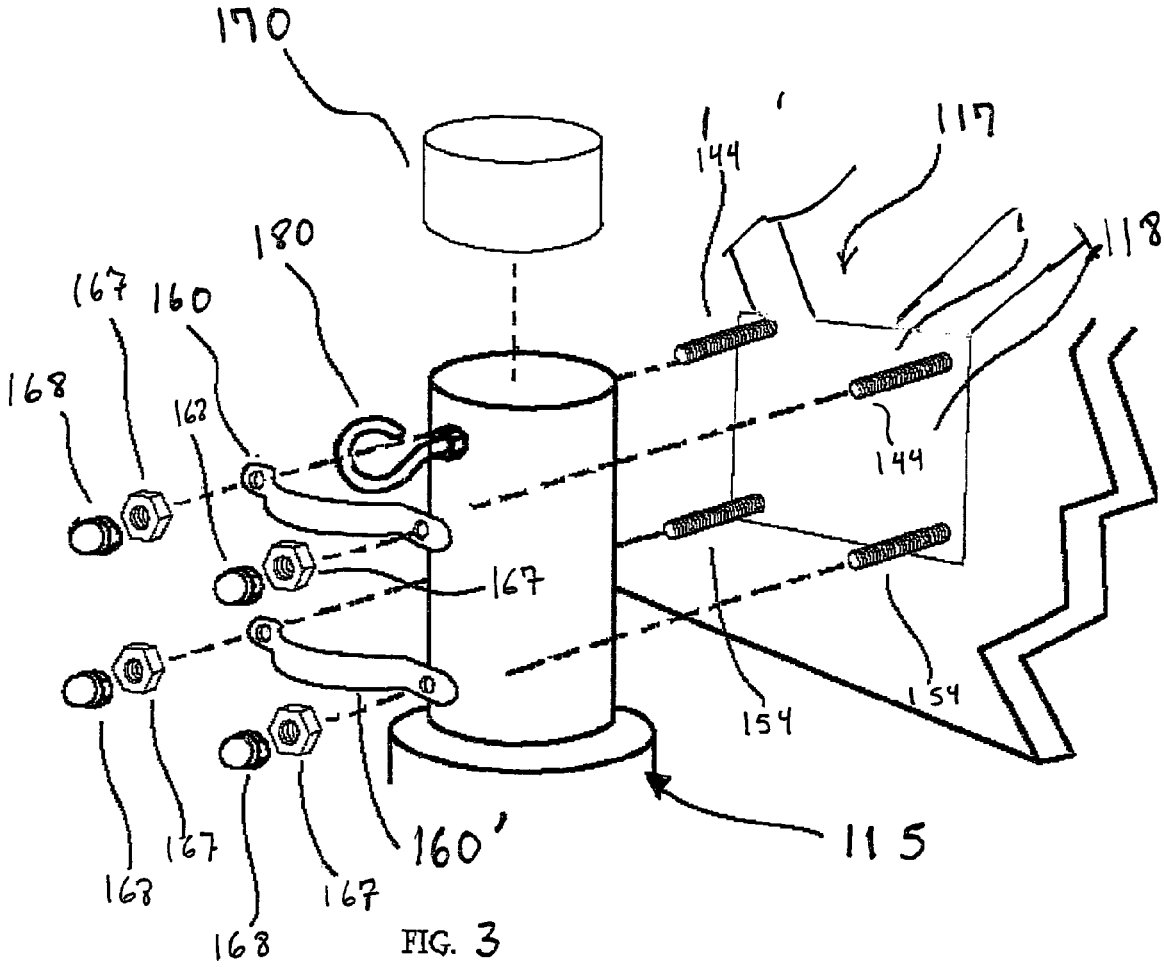
FIG. 3 is an exploded perspective view showing the mounting of the rear portion of the backboard and brace with a post.

The method of connecting the mated assembly that includes receiving plate 130, L-shaped plate 125 to pole 115 is illustrated by the exploded perspective view of FIG. 3 which shows the rear portion of the backboard 110 at the square shaped plate 118. As shown in the exploded perspective view of FIG. 4, rim 120 is mounted into or nested within the inner boundary of the receiving plate 130.

Pole clamps 160 and 160' have a semicircular middle portion to engage the periphery of pole 115 with holes at each end for receiving the threaded shafts of bolts 145 and 155. The pair of longer bolts 145 passes through the holes in upper pole clamp 160 in FIG. 3, while the shorter pair of bolts 155 passes through the hole in the lower pole clamp 160'. Thus, when hex nuts 167 are inserted on bolt pairs 145 and 155 thier tightening urges bolt clamp 160 and 160' into frictional connection with post 115. The hex nut 167 preferably have "Nylon" insert which deform slightly as the hex nuts are tightened to more securely connect shafts 147 and 157 of bolts 145 and 155 respectively. Finally, the end of the shafts of bolts 145 and 155 are covered by the insertion and threading of acorn nuts 168.

FIGS. 5A and 5B are cross-sectional elevations of the backboard 120 through the center of rim 120 to explain the operative function between the connection of receiving plate 130 to L-shaped plate 125 via bolt pairs 145 and 155. The edge of the rim 120 is preferably welded to connect with the edge of the vertical portions of L-shaped plate 125. L-shaped plate 125 vertical portion is a rectangular plate 127 with holes 124*a, b, c* and *d* for receiving shafts 144, 154 of bolts 145 and 155 respectively. The back edge of rim 120 is connected to L-shaped plate 125 by two horizontal members 126 and 126'. The arms 116 and 116' of the Y-shaped diagonal brace extend in the vertical plane perpendicular to the backboard surface from the edge of the horizontal members 126 to the bottom of rectangular portion 127.

As shown in FIGS. 5A and 5B, bolts 147 and 157 pass through holes 124 of rim supporting plate 127 as well as holes 134 in receiving plate vertical face 137, and through backboard 110.

Spring pairs 145 and 155 are co-axially disposed about shaft 144 to maintain a fixed load between receiving plates 137 and 127. Springs 14S and 1146 are preferably disposed with a pair of circular cups illustrated in FIG. 6 and designated 164, each of which has central bore for receiving the bolt shaft. Thus, the assembly connecting the rim 120 to the backboard 110 is made by nesting the L-shapes plate 12S into receiving plate 130. The lower screws are preferably shorter so that they do not extend beyond the height of the adjacent portion of sidewalls 131 and 131', as illustrated in perspective view from under the rim in FIG. 6

FIG. 5B shows the assembly when the edge of rim 120 is exposed to upward loading. The inner L-plate 127 can rotate counter clockwise within confines of receiving plate 130 in response for force exerted on rim 120, which cause springs 145 and 155 to compress. Upon release of the deflecting force, the springs 145 and 155 urge faces 127 and 137 together, thus restoring L-shaped plate 125 and rim 120 to the proper horizontal position.

Thus, in this preferred embodiment the rim or hoop 120 is connected to the backboard 110 by springs that are co-axially disposed with their respective bolts to provide a shock absorbing connection. The shock absorbing connection maintains the vertical portion of said L-shaped plate 125 in a nested orientation with respect to the vertical portion of said L-shaped receiving plate 130 whereby the rim 120 responds to upward and downward vertical displacement by transferring energy to the shock absorbing connector. This shock absorbing connector then urges the rim 120 to a substantially horizontal orientation. It should be noted that edge 138 not only aids to limit the movement of face 127, but also to avoid creating a pinch point between surfaces 137 and 127 as springs 146 and 156 are compressed.

Figure 6:
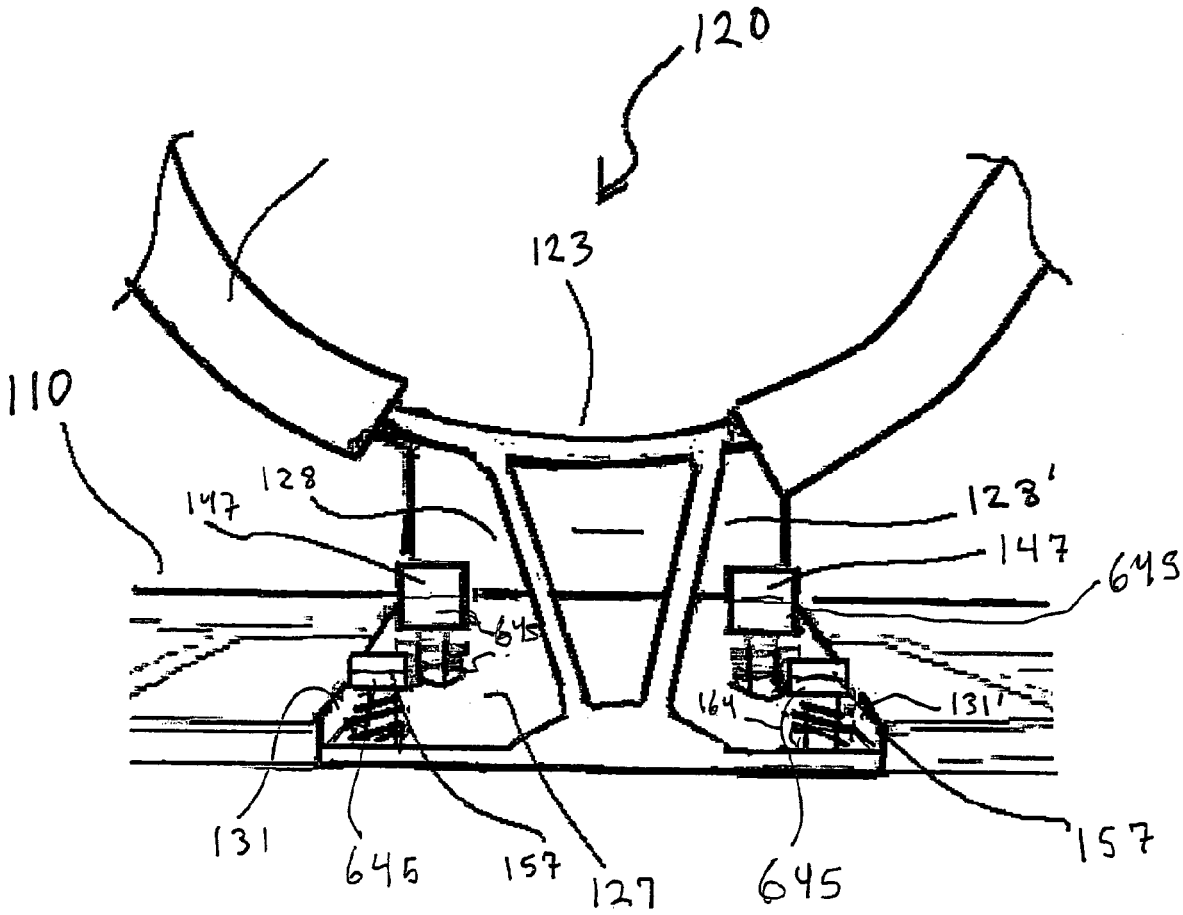
FIG. 6 is a perspective view taken looking upward at the assembly portion that connects the rim to the backboard from the front side of the backboard shown in FIG. 1.

FIG. 6 is a perspective illustration taken looking upward, that is from below the rim 120, showing the L-plate 125 when the rim 125 is affixed to backboard 110. The height of screw heads 47 and 158 can be adjusted to vary the compression on the associated springs to modify the flexibility and energy absorbing capacity of the rim assembly.

While the invention has been described in connection with a preferred embodiment, it is not intended to limit the scope of the invention to the particular form set forth, but on the contrary, it is intended to cover such alternatives, modifications, and equivalents as may be within the spirit and scope of the invention as defined by the appended claims.

The invention claimed is:

1. A basketball hoop and backboard assembly comprising:

a) a vertically disposed rebounding board, b) a substantially circular hoop having an L-shaped brace plate with a portion thereof horizontally extending and another portion extending vertically, wherein the horizontally extending portion of said brace plate is disposed in the horizontal plane defined by the hoop, being rigidly connected to an arc of said hoop, c) an L-shaped receiving plate mounted to said rebounding board having a horizontal portion extending outward and a vertical portion extending downward, the vertical portion being connected to said rebounding board, d) wherein said hoop is connected to said rebounding board by via a shock absorbing connector disposed to maintain the vertical portion of said L-shaped brace in a nested orientation with respect to the vertical portion of said L-shaped receiving plate whereby the hoop responds to upward and downward vertical displacement by transferring energy to the shock absorbing connector, wherein the shock absorbing connector then urges said hoop to a substantially horizontal orientation wherein said shock absorbing member is a plurality of pairs of springs, wherein the first pair are two parallel and spaced apart springs disposed at a first height and the second pair of springs are two parallel and spaced apart springs disposed at a second height that is below the first height and wherein an elastic energy absorbing member surrounds said hoop.

2. A basketball hoop and backboard assembly according to claim 1 wherein said shock absorbing member is a plurality of springs.

3. A basketball hoop and backboard assembly according to claim 2 wherein said L-shaped receiving plate has lateral sides for preventing the lateral movement of the L-shaped brace plate of said substantially circular hoop.

4. A basketball hoop and backboard assembly according to claim 1 wherein the hoop provides substantial upward and downward vertical displacement when subjected to the same force but from the upward and downward direction respectively.

5. A basketball hoop and backboard assembly according to claim 4 wherein said shock absorbing member is a plurality of springs.

6. A basketball hoop and backboard assembly according to claim 5 that further comprises an elastic energy absorbing member surrounding said rim.

7. A basketball hoop and backboard assembly according to claim 1 wherein the compression of spring is independently adjustable to vary the flexure characteristics of the rim.

8. A basketball hoop and backboard assembly according to claim 5 wherein the compression of each spring is independently adjustable to vary the flexure characteristics of the rim.

9. A basketball hoop and backboard assembly comprising:

a) a vertically disposed rebounding board, b) a substantially circular hoop having an L-shaped brace plate with a portion thereof horizontally extending and another portion extending vertically, wherein the horizontally extending portion of said brace plate is disposed in the horizontal plane defined by the hoop, being rigidly connected to an arc of said hoop, c) wherein said hoop is connected to said rebounding board via a shock absorbing connector whereby the hoop responds to upward and downward vertical displacement by transferring energy to the shock absorbing connector, wherein the shock absorbing connector then urges said hoop to a substantially horizontal orientation wherein said shock absorbing member is a plurality of pairs of springs, wherein the first pair are two parallel and spaced apart springs disposed at a first height and the second pair of springs are two parallel and spaced apart springs disposed at a second height that is below the first height and wherein an elastic energy absorbing member surrounds said hoop.

10. A basketball hoop and backboard assembly according to claim 9 wherein the hoop responds to lateral displacement by transferring energy to the shock absorbing connector, wherein the shock absorbing connector then urges said hoop to a substantially orthogonal orientation with respect to said backboard.

* * * * *